United States Patent [19]

Geisselbrecht

[11] 3,958,803

[45] May 25, 1976

[54] GYMNASTIC PUSH-PULL EXERCISE APPLIANCE

[76] Inventor: Werner Geisselbrecht, 3001 Meitze, Germany

[22] Filed: Mar. 17, 1975

[21] Appl. No.: 559,199

[30] Foreign Application Priority Data

July 3, 1974 Germany ..... 2431882

[52] U.S. Cl. ..... 272/135; 267/149; 273/DIG. 7; 272/140

[51] Int. Cl.[2] ..... A63B 21/00

[58] Field of Search ..... 272/82, 83 R, DIG. 5, 272/68, 76, 70, 67; 273/DIG. 7; 29/173; 267/61 R, 149

[56] References Cited

UNITED STATES PATENTS

| | | | |
|---|---|---|---|
| 2,913,240 | 11/1959 | Mohr | 267/149 |
| 3,268,225 | 8/1966 | Kolbel | 272/83 R |
| 3,427,021 | 2/1969 | Donato | 272/83 R X |
| 3,759,514 | 9/1973 | Cox | 272/82 X |

*Primary Examiner*—Richard C. Pinkham
*Assistant Examiner*—William R. Browne
*Attorney, Agent, or Firm*—Allison C. Collard

[57] ABSTRACT

This invention provides an improved pull and press exercise appliance having two tubes which fit telescopically into each other with gripping handles at opposite ends which are interconnected by pliable elastic spring elements. For push exercises the spring elements bow outwardly when the handles are pushed together, while for pull exercises the spring elements are pulled apart midway between the handles.

6 Claims, 5 Drawing Figures

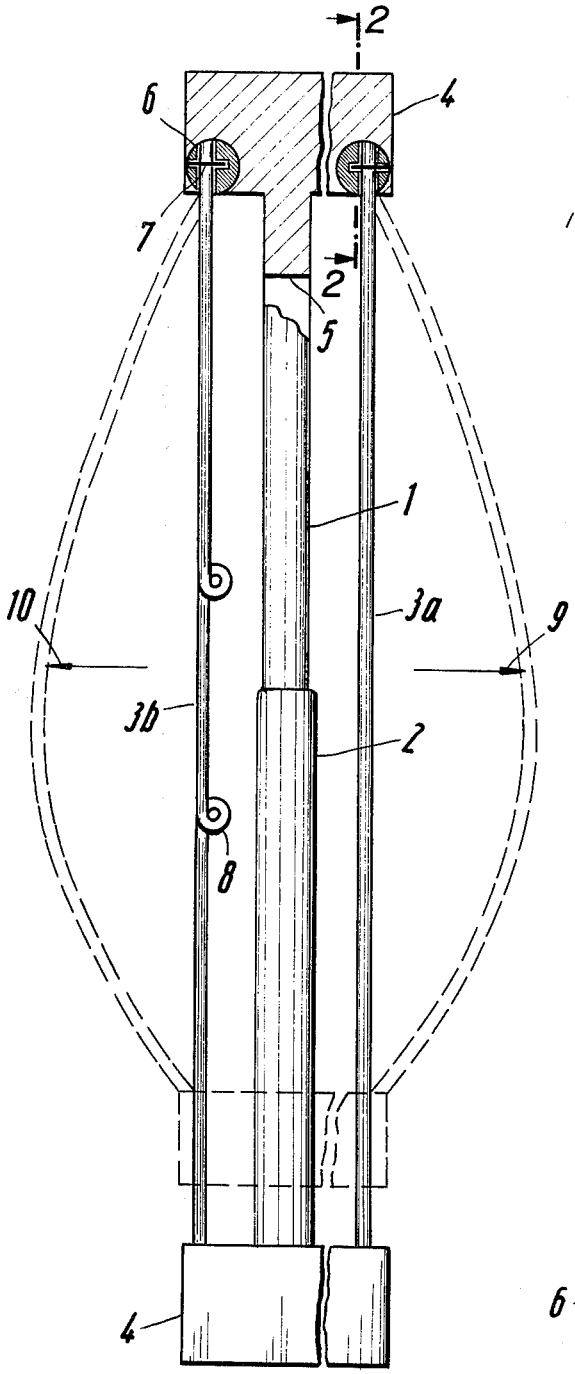
Fig. 1
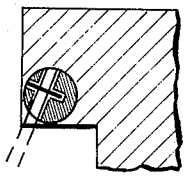
Fig. 1a
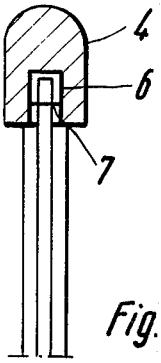
Fig. 2
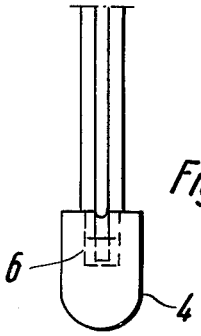
Fig. 3
Fig. 4

GYMNASTIC PUSH-PULL EXERCISE APPLIANCE

The invention relates to a gymnastic exercise appliance for pull- and press exercises consisting of two telescopic tubes which fit into one another and which have gripping handles at their outer ends.

Gymnastic appliances are known for the purpose of press exercises consisting of two tubes fitting one within the other in the manner of a telescope, with an internal coil spring, the tubes having at their outer ends disk-shaped, rubber-covered handles. Such appliances are unsuitable for pull exercises and for combined press-and pull exercises.

According to present thinking in gymnastic theory the whole muscular system can be toned up and developed by using a determined number of selected press- and pull exercises. In order to achieve this it has been proposed, according to the German Pat. No. 1,173,001 to employ an appliance as aforesaid with endless rope which interconnects the two handles. Pressing exercises are carried out by pushing the two handles together, thereby telescoping the two tubes against the action of the coil spring, whilst for pull exercises two parts of the rope will have to be gripped mid-way between the handles and pulled apart. The press-and pull exercises tone up mainly the muscular system of the arms and the pull exercises in addition tone up the muscular system of the legs.

The use of a coil spring extending the entire length of the telescopic tube is technically expensive for a gymnastic exercise appliance. It is an object of this invention to provide an improved appliance of simplified construction.

According to the invention there is provided a gymnastic exercise appliance for pull- and press exercises, comprising two tubes which fit telescopically into one another and which have at their outer ends gripping handles, wherein the handles are interconnected by pliable elastic spring elements.

The spring elements may consist of rods or bars of glass fibre reinforced plastics or of metal. When metal bars or rods are used, they may be provided with one or more twists or loops in order to achieve the desired elasticity.

The ends of the spring elements are preferably pivotally connected to the handles for pivotal movement relative thereto upon flexion of the spring elements. A swivel hub or a ball-and-socket swivel joint may be best suited for such pivotal connections.

The invention will be further described, by way of example, with reference to the accompanying drawings, in which:

FIG. 1 is a partly sectioned front elevation of an exercise appliance according to the invention;

FIG. 1*a* is a cross-sectional view of part of one of the handles of the appliance, showing a laterally deflected spring;

FIG. 2 is a longitudinal cross-section of one end of the appliance, taken on line 2—2 in FIG. 1, and FIG. 3 is a side elevational view of one of the handles of the appliance, and FIG. 4 is a partly sectional front elevation of a different example of spring elements in the appliance.

The illustrated embodiment of the gymnastic exercise appliance according to the invention consists of two tubes 1 and 2 that fit into one another telescopically. The outer ends of the tubes 1 and 2 are closed by gripping handles 4 which also serve as abutments for two pliable elastic spring elements 3*a* and 3*b* in the form of resilient rods or bars.

In FIG. 1 and FIG. 4, respectively two alternative examples of the spring elements are illustrated: the spring element 3*a* comprises a simple elastically pliable rod of glass fibre-reinforced plastics material, while the spring element 3*b* comprises a metal rod formed with loops 8.

Each of the two handles 4 has an integral projection 5 which is a press fit into the outer end of the adjacent tube 1 or 2 so as to be securely attached thereto.

The ends of the spring elements 3*a* and 3*b* are anchored to respective hubs 6 by means of safety disks 7, the hubs 6 being rotatable in respective sockets in the handles 4, as illustrated in FIG. 1*a*. The hubs 6 can pivot about an axis perpendicular to the plane of flexion of the spring elements 3*a*, 3*b*. The hubs 6 could be replaced by ball-joints or other joint or hinge elements.

The safety disks 7 can be slid into engagement with the respective spring element in one direction, whilst in the opposite direction they hold the ends of the spring element immovably tight, thereby being able to transmit considerable force.

In order to perform pulling exercises, the spring elements 3*a* and 3*b* are gripped manually in the middle and pulled apart, in the directions of the arrows 9 and 10, as represented by the broken lines in the drawing. Should one desire to develop the muscular system of the legs, the spring elements should be pulled apart by the feet in the direction of the arrows 9 and 10.

The gymnastic exercise appliance according to the invention can be used for both pull- and press exercises and has the advantage of being technically very simple. The appliance is also lighter than those which employ internal springs, since there are no components inside the telescopic tubes. The assembly cost is reduced by at least one third. Moreover, since there is no internal spring, the telescopic tubes can be of smaller diameter than those of the previously mentioned known appliances, and can be manufactured in plastics or synthetic material.

What is claimed is:

1. A gymnastic exercise appliance for pull and press exercises comprising:

two empty hollow tubes which fit telescopically into one another;

said hollow tubes having no structure positioned internally of the tubes;

a handle mounted on the outer end of each of said tubes; and a plurality of elastic spring gripping means for directly and uninterruptingly connecting one handle with the other handle to resist any inward collapsing or telescoping action of the tubes; said means includes elongated elements positioned substantially parallel to the common central longitudinal axis of the tubes and lying outside the tubes, said spring elements constituting linear elastic springs along their entire lengths.

2. The gymnastic exercise appliance according to claim 1 wherein each spring gripping element comprises a rod of glass fibre-reinforced plastic material.

3. The gymnastic exercise appliance according to claim 1 wherein each spring gripping element consists of a metal rod.

4. The gymnastic exercise appliance according to claim 3 wherein each spring gripping element is formed with at least one twist or loop.

5. The gymnastic exercise appliance according to claim 1 additionally comprising pivot means for connecting the ends of said spring gripping elements to said handles for pivotal movement relative thereon upon flexion of the spring gripping elements.

6. The gymnastic exercise appliance as recited in claim 5, wherein said handles each having an integral projection press fit into one of said tubes, said pivot means are disposed in said handles rotatable about an axis perpendicular to a plane of said flexion of said spring gripping elements and safety disc means for anchoring the ends of said spring gripping elements tight to said handles.

* * * * *